US007234606B2

(12) United States Patent
Kraus et al.

(10) Patent No.: US 7,234,606 B2
(45) Date of Patent: Jun. 26, 2007

(54) BABY BOTTLE WITH ENLARGED LOWER PORTION

(75) Inventors: Stephanie Kraus, Glendale, CA (US); Randal Ouye, La Crescenta, CA (US)

(73) Assignee: Disney Enterprises, Inc., Burbank, CA (US)

( * ) Notice: Subject to any disclaimer, the term of this patent is extended or adjusted under 35 U.S.C. 154(b) by 78 days.

(21) Appl. No.: 11/091,971

(22) Filed: Mar. 28, 2005

(65) Prior Publication Data

US 2006/0213855 A1 Sep. 28, 2006

(51) Int. Cl.
*A61J 9/00* (2006.01)
*A61J 9/08* (2006.01)

(52) U.S. Cl. ..... 215/11.1; 215/11.6; 23/197

(58) Field of Classification Search ..... 215/11.1, 215/11.6; D24/197
See application file for complete search history.

(56) References Cited

U.S. PATENT DOCUMENTS

| | | | | | |
|---|---|---|---|---|---|
| 26,327 | A | * | 11/1859 | La Forme | 215/11.1 |
| 177,185 | A | * | 5/1876 | Whitney | 215/11.1 |
| 179,416 | A | * | 7/1876 | Kennish | 215/11.1 |
| 595,986 | A | * | 12/1897 | Worley | 215/11.1 |
| 1,183,728 | A | * | 5/1916 | Griffith | 215/11.1 |
| 1,518,823 | A | * | 12/1924 | Schmidt et al. | 215/11.1 |
| 1,669,892 | A | * | 5/1928 | Beck | 215/11.5 |
| 2,588,991 | A | * | 3/1952 | Schellin | 215/11.1 |
| 3,661,288 | A | * | 5/1972 | Noll | 215/11.1 |
| 4,714,174 | A | | 12/1987 | Williams | |
| 4,795,052 | A | | 1/1989 | Hayes, Jr. | |
| 4,801,027 | A | | 1/1989 | Hunter | |
| 4,915,250 | A | | 4/1990 | Hayes, Jr. | |
| 4,953,737 | A | | 9/1990 | Meyers | |
| 5,050,759 | A | | 9/1991 | Marble | |
| 5,294,018 | A | | 3/1994 | Boucher | |
| D371,779 | S | | 7/1996 | Nowak et al. | |
| D376,734 | S | | 12/1996 | Petrie | |
| D379,495 | S | | 5/1997 | Sidman et al. | |
| D383,847 | S | * | 9/1997 | Skinner | D24/197 |
| D383,911 | S | | 9/1997 | Conforti et al. | |
| 5,669,665 | A | | 9/1997 | Nowak | |
| D386,104 | S | | 11/1997 | Nowak | |
| D386,703 | S | | 11/1997 | Nowak | |
| D387,239 | S | | 12/1997 | Johnstone | |
| D389,359 | S | | 1/1998 | Nowak | |
| D390,135 | S | | 2/1998 | Rossman et al. | |
| D391,407 | S | | 3/1998 | Rossman et al. | |
| 5,725,117 | A | | 3/1998 | Berjis | |

(Continued)

*Primary Examiner*—Sue A. Weaver
(74) *Attorney, Agent, or Firm*—Greenberg Traurig, LLP

(57) ABSTRACT

A baby bottle has an essentially pear side wall profile shape. There is a truncated end to the essentially pear side wall profile shape. A projecting ridge portion is located towards the top of the truncated end of the essentially pear side wall profile shape for facilitating holding of the bottle. There is a rim at the top of the side wall for receiving a nipple locating closure. In another format the baby bottle has an elongated side wall. A bottom portion of the wall is of a diameter greater than the diameter towards the top of the bottle. The bottle is formed such the relatively largest diameter portion of the side wall is located about one third from the bottom portion of the bottle. The center of gravity of the bottle is below the midpoint of the longitudinal length.

7 Claims, 2 Drawing Sheets

U.S. PATENT DOCUMENTS

D393,315 S * 4/1998 Crisi ..... D24/197
D394,166 S 5/1998 Rossman et al.
5,755,489 A 5/1998 Rossman et al.
5,761,756 A 6/1998 Nowak et al.
5,763,796 A 6/1998 Britto et al.
5,765,715 A 6/1998 Hughes
5,772,088 A 6/1998 Nelson
D395,832 S 7/1998 Rossman et al.
D396,292 S 7/1998 Nowak
D396,717 S 8/1998 Sidman et al.
5,833,189 A 11/1998 Rossman et al.
D403,842 S 1/1999 Bair et al.
5,871,118 A 2/1999 Franzese
5,890,620 A 4/1999 Belcastro
5,893,472 A 4/1999 Forrer
D411,349 S 6/1999 Johnstone
D412,292 S 7/1999 Nowak et al.
5,938,053 A 8/1999 Verbovszky et al.
D413,792 S 9/1999 Hotaling et al.
D417,275 S 11/1999 Conforti
5,993,285 A 11/1999 Sofia et al.
5,993,478 A 11/1999 Nowak
D417,914 S 12/1999 Nowak
6,000,750 A 12/1999 Rossman et al.
D419,785 S 2/2000 Conforti et al.
D421,125 S 2/2000 Nowak
D421,126 S 2/2000 Nowak
6,026,528 A 2/2000 Pina
D421,469 S 3/2000 Reinke et al.
6,033,019 A 3/2000 Hession-Kunz et al.
6,037,872 A 3/2000 Dunnum
D422,849 S 4/2000 Knight et al.
6,045,254 A 4/2000 Inbar et al.
6,049,954 A 4/2000 Britto
D424,203 S 5/2000 Nowak
D424,312 S 5/2000 Hotaling et al.
D424,958 S 5/2000 Nowak
D426,300 S 6/2000 Conforti
6,073,788 A * 6/2000 Stroud ..... 215/11.1
6,089,653 A 7/2000 Hotaling et al.
D430,052 S 8/2000 Nowak
D430,737 S 9/2000 Nowak et al.
D432,342 S 10/2000 Popek et al.
RE37,016 E 1/2001 Morano
D436,655 S 1/2001 Hotaling et al.
D436,800 S 1/2001 Nowak et al.
6,168,034 B1 * 1/2001 Perrone ..... 215/11.1
6,176,042 B1 1/2001 Rossman et al.
6,202,247 B1 3/2001 Lorenz, Jr.
6,212,706 B1 4/2001 Rossman et al.
D443,233 S 6/2001 Gaudet et al.
6,253,392 B1 7/2001 Conforti et al.
6,269,968 B1 8/2001 Belcastro
6,322,149 B1 11/2001 Conforti et al.
6,325,236 B1 12/2001 Wong
6,354,708 B1 3/2002 Monahan et al.
D460,322 S 7/2002 Orr et al.
6,412,527 B1 7/2002 Brice
6,415,460 B1 7/2002 Rossman et al.
D461,361 S 8/2002 Orr et al.
D465,423 S 11/2002 Larson et al.
6,478,435 B2 11/2002 Monahan et al.
D467,125 S 12/2002 Orr et al.
6,499,254 B2 12/2002 Rossman et al.
D469,860 S 2/2003 Riemer et al.
6,513,379 B2 2/2003 Meyers et al.
6,536,163 B1 3/2003 Monahan et al.
6,536,502 B2 3/2003 Britto et al.
6,571,981 B2 6/2003 Rohlfs
6,578,209 B2 6/2003 Lopes et al.
D478,669 S 8/2003 Wear
6,640,992 B1 11/2003 Berger et al.
6,648,396 B2 11/2003 Monahan et al.
6,658,678 B2 12/2003 Hotaling et al.
6,658,681 B2 12/2003 Britto et al.
6,673,036 B1 1/2004 Britto
6,692,072 B2 2/2004 Nelson et al.
6,695,678 B1 2/2004 Foley et al.
6,749,582 B2 6/2004 Britto et al.
6,802,757 B1 10/2004 Sejnowski
6,834,400 B2 12/2004 Zanardelli et al.
6,840,918 B1 1/2005 Britto et al.
D502,551 S 3/2005 Hotaling et al.
6,910,594 B2 6/2005 Foley et al.
6,923,337 B2 8/2005 Hession et al.
6,928,674 B2 8/2005 Blackburn
6,954,955 B2 10/2005 Brewin et al.
6,964,572 B2 11/2005 Cesa
6,976,604 B2 12/2005 Connors, Jr. et al.

* cited by examiner

FIG. 1
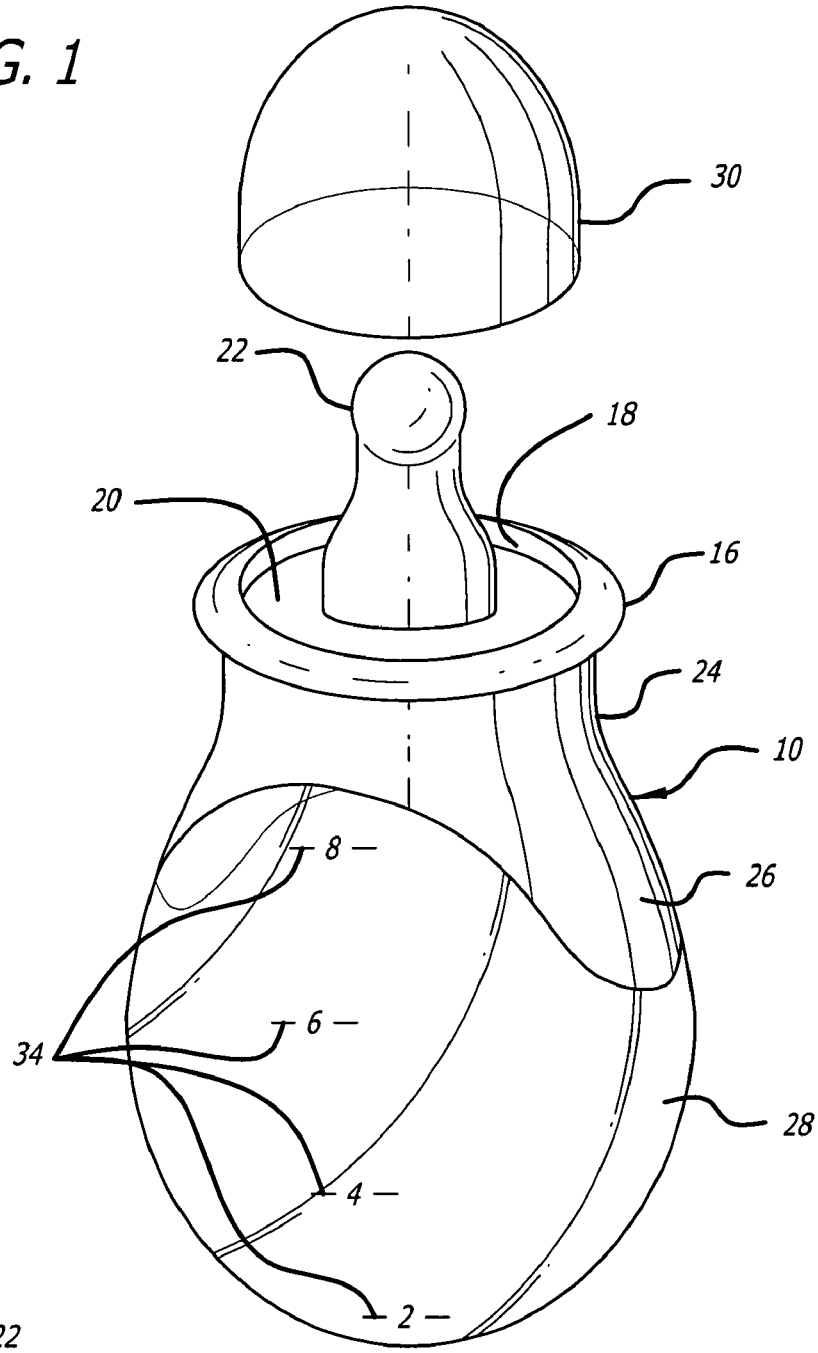
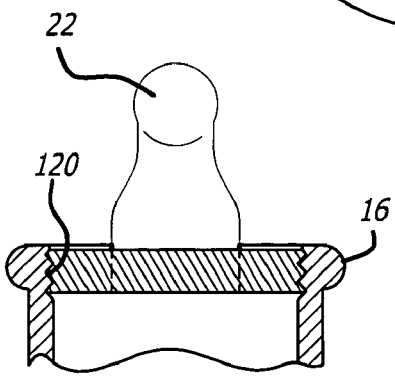
FIG. 4
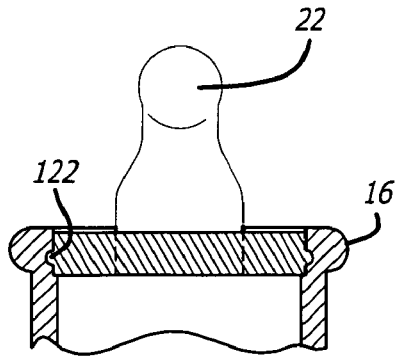
FIG. 5

BABY BOTTLE WITH ENLARGED LOWER PORTION

RELATED APPLICATIONS

This application is related to U.S. Utility Patent Application Ser. No. 11/092,459, filed on Mar. 28, 2005, entitled "MULTI-COMPARTMENT DISPENSING CONTAINER"; U.S. Utility Patent Application Ser. No. 11/092,361, filed on Mar. 28, 2005, entitled "CLEANING UTENSIL FOR A FLUID CONTAINER"; U.S. Utility Patent Application Ser. No. 11/092,361, filed on Mar. 28, 2005, entitled "IRREGULAR SHAPED BABY BOTTLE"; and U.S. Utility Patent Application Ser. No. 11/091,973, filed on Mar. 28, 2005, entitled "A HANDLED DRINKING CONTAINER"; all of which have been filed concurrently herewith. The contents of those applications are incorporated by reference herein.

BACKGROUND

1. Field

This disclosure relates to baby bottle constructions. More particularly the disclosure relates to an ergonomically designed baby bottle.

2. General Background

There are numerous baby bottles on the market, with different functions and features. None of the known bottles provide the features of the present disclosure. The prior art is replete with varying baby bottle sizes and constructions. However, none of the bottles appear to address needs that arise to collectively facilitate balance, handling, and ease of feeding infants.

While the prior art constructions may be adequate for the basic purpose and function for which they have been designed, they fail to provide a simple, efficient, and practical feeding bottle. In particular, the prior art fails to disclose a bottle sized and constructed to enhance an infant's grasp of the bottle and comfort while gripping the bottle.

There is a need for an improved ergonomically designed baby bottle construction that simplifies feeding, and the support functions associated with this.

It is an object of the present disclosure to provide a baby bottle to facilitate drinking, and at the same time making feeding an easier function for the feeding person.

SUMMARY

A baby bottle has an essentially pear side wall profile shape. There is a truncated end to the essentially pear side wall profile shape. A projecting ridge portion is located towards the top of the truncated end of the essentially pear side wall profile shape for facilitating holding of the bottle. There is a rim at the top of the side wall for receiving a nipple locating closure.

In some cases, the bottom of the bottle is flat and interfaces with the upstanding side wall of the bottle.

In another form, the baby bottle has an elongated curved side wall, and the top of the side wall is for receiving a nipple locating closure. A bottom portion of the wall has a diameter greater than the diameter towards the top of the bottle, and there can be a convex curvature. The bottle is formed such that the relatively largest diameter portion of the side wall is located about one third from the bottom portion of the bottle. The topmost quarter of the side wall can be relatively straight or have a relatively concave curvature. Generally, the wall shape curvatures from the bottom to the top blend harmoniously in a gentle transition.

A projecting ridge portion is relatively closer towards the top than the bottom of the bottle. The projecting ridge portion extends circumferentially in a circle about the wall. The ridge is located substantially in the area of the narrow diameter, and extends circumferentially about the wall in a relatively transverse sense.

DRAWINGS

The above-mentioned features and objects of the present disclosure will become more apparent with reference to the following description taken in conjunction with the accompanying drawings, wherein like reference numerals denote like elements, and in which:

FIG. 1 is a perspective view of the bottle with the cover removed.

FIG. 4 is a partial side view of the interlock between the rim and the nipple locating closure.

FIG. 5 is a partial side view of the interlock between the rim and the nipple locating closure in an alternate configuration.

DETAILED DESCRIPTION

Figure 2:
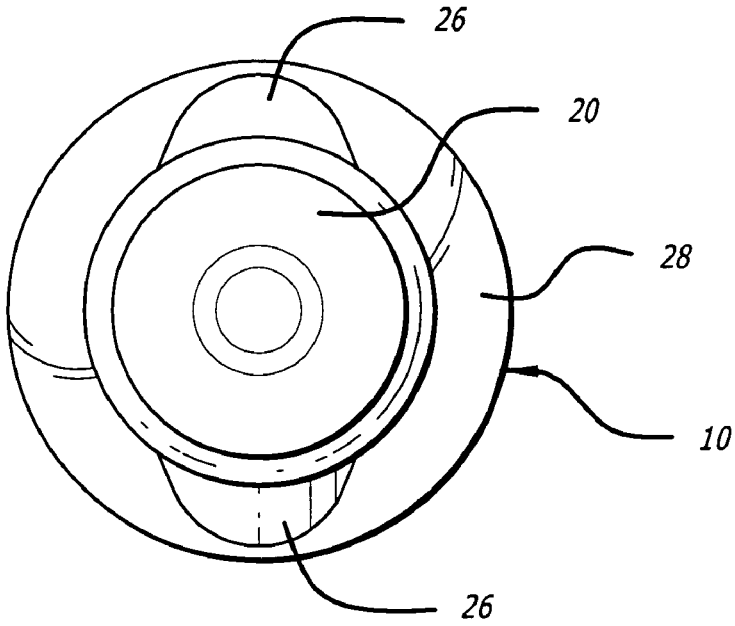
FIG. 2 is a top view of the bottle.

The device is now described with reference to an example which is not to be considered as limiting. This is purely an illustration of the device.

One of ordinary skill in the art will understand that the present discussion is a description of exemplary embodiments only, and is not intended as limiting the broader aspects of the present disclosure, which broader aspects are embodied in the exemplary construction. A repeat use of reference characters in the present specification and drawings represents the same or analogous features or elements of the disclosure.

A baby bottle has an essentially pear side wall profile shape. There is a truncated end to the essentially pear side wall profile shape. A projecting ridge portion is located towards the top of the truncated end of the essentially pear side wall profile shape for facilitating holding of the bottle. There is a rim at the top of the side wall for receiving a nipple locating closure. In one form, the bottom of the bottle is flat and interfaces with the side wall of the bottle.

The projecting ridge portion is relatively closer towards the top than the bottom of the bottle and extends circumferentially in a transverse circle about the wall. The projecting ridge portion extends from the relatively straight longitudinal portion of the wall. The ridge is located substantially in the area of the narrow diameter of the bottle.

The wall can be formed by at least two portions or areas. One portion or area is essentially transparent and the other portion or area is essentially opaque. There is a line of distinction between the two portions that is sinuously curved circumferentially around the wall in a circular transverse sense at a location between the truncated top and the bottom of the container.

A cover is provided for the nipple locating closure. The cover is removable, curved and selectively snaps into a location inside or with the ridge at the truncated end.

The nipple locating closure can have a central portion with an aperture for receiving a removable nipple. The peripheral zone has a transparent portion for a window permitting viewing of the interior of the bottle when located on the top of the bottle.

In another format the baby bottle has an elongated side wall, and the top of the side wall receives a nipple locating closure. A bottom portion of the wall is of a diameter greater than the diameter towards the top of the bottle. The bottle is formed such that the relatively largest diameter portion of the side wall is located about one third from the bottom portion of the bottle.

Figure 3:
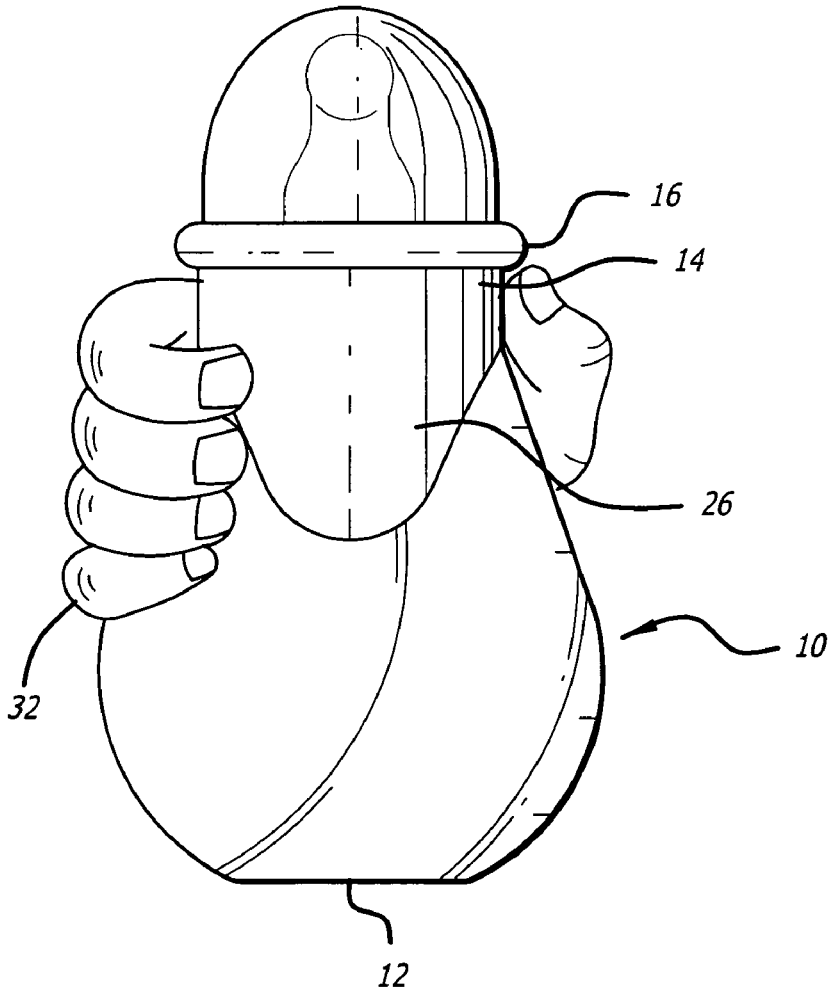
FIG. 3 is a side view of the bottle.

In FIG. 1, there is the perspective view of a pear-shaped baby bottle generally indicated as 10. As can be seen in the side profile of FIG. 3, the pear-shaped bottle 10 has a flat base 12 and a truncated end 14. There is a projecting ridge 16 which is located towards the top 14 for facilitating holding of the bottle. On the inside of the ridge 16, there is a rim 18 for receiving a nipple locating closure 20. The nipple 22 is formed centrally in the closure 20, and is shaped to essentially mimic a human breast nipple and is flexible in response to sucking. The ridge 16 extends circumferentially about the wall 24 which constitutes the bottle, and as can be seen, is at the narrow diameter location of the bottle. The nipple locating closure 20 can clip or screw thread into position with the rim 18 to effect an effective seal. This thread or clip engagement is an internal thread 120 or clip 122 mechanism for engaging the top of the bottle 10 and closure 20.

The wall 24 is formed of two sections 26, one of which is an opaque section and one of which is a substantially transparent portion 28. The portion 28 is below the substantially opaque portion 26. The opaque portion can be of a material to enhance to gripping by the fingers and/or hand generally. Above the nipple 22, there is a substantially hemispherically formed cover 30 which can clip 120 or thread 122 inside the rim 18 so as to hygienically protect the nipple 22. The inter-engagement is such that leakage does not occur. The curved or domed top or cover 30 provides an aesthetic closure to the baby bottle.

The bottle can be of any particular size, and the shape, which is relatively squat, is of a nature that it is formed to match a baby's hand, which is figuratively illustrated by numeral 32 which represents the fingers of the hand.

Additionally, the bottle is easy to hold by a caregiver, such as a mother. It is easy to clean, easy to fill and is leak-proof in its formation of the inter-engaging component parts.

In some other forms of the disclosure, instead of the two substantially equal in area sections which are substantially opaque and substantially transparent, there can be more or less of either one of such sections. The substantially opaque section 26 extends from the top 14 of the bottle downwardly on two sides and is centrally higher on two opposite sides. In this fashion, the opaque section has a substantially curved or substantially sinuous interface which is advantageous. On the face 28 there can be indicia 34 which indicate the measurement height of the bottle so that the amount of liquid in the bottle can easily measured and visibly assessed.

Different degrees of height relative to width are possible. The bottle has a larger lower portion or cross-section than the upper portion or upper cross-section. In this manner, an enhanced, balanced bottle is obtained. Different angular configurations are possible. The center of gravity of the bottle is below the midpoint of the longitudinal length or height of the bottle. The location of the center of gravity is determined with the nipple closure and nipple in place. Alternatively, it is determined without the closure or nipple in place.

The cylindrical top portion and the body may be molded of a suitable plastic material, which may be blow molded, by extrusion or injection, so that it is a unitary member of uniform wall thickness. A suitable transparent plastic for forming the bottle includes, but is not limited to, polystyrene, polystyrene-acrylonitile, acrylonitile-butadiene-styrene, styrene-maleicanhydride, polycarbonate, polyethylene terephthalate, polyvinylcyclohexane, and blends thereof. The thickness of the wall can be such that it is not generally flexible. The bottle itself is made of a relatively lightweight material.

In another form, there is an elongated side wall having an enlarged diameter in an area towards the base and tapering upwardly towards a narrower diameter. The narrower diameter includes a relatively straight longitudinal portion. There is a rim at the top of the wall for receiving a nipple locating closure. The neck of the bottle around which the hand can hold the bottle is about 60–80% of the diameter of the enlarged lower portion. It is sufficient that the neck can locate a nipple closure element which itself can locate a nipple which generally is sized for the mouth of a baby. Accordingly, it is not a narrow neck such as can be common on a soda bottle which is for receiving a crown cork or a cap closure.

Different degrees of relatively squat appearance of the reusable bottle and components making up the reusable bottle are possible. In other words the pear shape can be relatively broader and shorter, or alternatively relatively broader and longer. Having the bottle with the center of gravity at a lower portion below the midpoint of the height provides for enhanced stability. The reusable bottle and its components can be suitably cleaned by hand, dishwasher or the like, so that repetitive use is possible. The two portions of the wall are relatively solid or distinct portions, meaning that one distinct portion is opaque and the other is transparent. In other cases, there are two substantially distinct different opaque type portions.

While the product and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A baby bottle, comprising:

an essentially pear-shaped elongated wall, the wall being formed by at least two portions, one portion being a bottom portion that includes at least essentially transparent windows, and the other portion being a top portion above the bottom potion, the top portion being essentially opaque;

a line of distinction between the top portion and the bottom portion, the line of distinction being sinuously curved circumferentially around the essentially pear-shaped elongated wall;

a projecting ridge portion towards the top of the essentially pear-shaped side wall for facilitating holding of the baby bottle, and a rim at the top of the essentially pear-shaped elongated wall for receiving a nipple locating closure, and wherein the bottom of the bottle is flat and interfaces with the essentially pear-shaped elongated wall.

2. The baby bottle of claim 1, wherein the projecting ridge portion is relatively closer towards the top than the bottom of the baby bottle.

3. The baby bottle of claim 1, further comprising a cover for the nipple locating closure.

4. The baby bottle of claim 1, wherein the nipple locating closure selectively snaps into a location inside the ridge at the top of the bottle.

5. The baby bottle of claim 1, wherein the projecting ridge portion extends circumferentially in a circle about the outside of the essentially pear-shaped elongated wall.

6. The baby bottle of claim 1, wherein a first cross section of the top portion has a diameter that is about sixty to eighty percent of the diameter of a second cross section of the bottom portion.

7. The baby bottle of claim 1, wherein the center of gravity of the baby bottle is located below the midpoint of the longitudinal length of the baby bottle.

* * * * *

UNITED STATES PATENT AND TRADEMARK OFFICE

CERTIFICATE OF CORRECTION

PATENT NO. : 7,234,606 B2
APPLICATION NO. : 11/091971
DATED : June 26, 2007
INVENTOR(S) : Stephanie Kraus and Randal Ouye It is certified that error appears in the above-identified patent and that said Letters Patent is hereby corrected as shown below:

Column 4, Line 52, should read, --portion above the bottom portion, the top portion being--

Signed and Sealed this

Twenty-first Day of August, 2007

JON W. DUDAS
*Director of the United States Patent and Trademark Office*